United States Patent [19]

Angelov et al.

[11] Patent Number: 4,634,520

[45] Date of Patent: Jan. 6, 1987

[54] DE-ASPHALTING HEAVY CRUDE OIL AND HEAVY CRUDE OIL/WATER EMULSIONS

[75] Inventors: Georgi Angelov, Don Mills; Paul W. M. Shibley, Oshawa, both of Canada

[73] Assignee: Bitumen Development Corporation Limited, Toronto, Canada

[21] Appl. No.: 663,298

[22] Filed: Oct. 22, 1984

[30] Foreign Application Priority Data

Nov. 4, 1983 [GB] United Kingdom ..... 8329570
Dec. 19, 1983 [GB] United Kingdom ..... 8333712

[51] Int. Cl.[4] ..... C10G 33/00; C10G 33/04; B01D 21/01

[52] U.S. Cl. ..... 208/309; 208/188; 208/187; 210/708; 210/729

[58] Field of Search ..... 208/309, 187, 188; 210/708, 729

[56] References Cited

U.S. PATENT DOCUMENTS

| | | | |
|---|---|---|---|
| 1,472,384 | 10/1923 | Brown | 208/187 |
| 2,235,639 | 3/1941 | Koch | 208/188 |
| 2,383,362 | 8/1945 | Batchelder | 208/188 |
| 3,321,394 | 5/1967 | Mills | 208/309 |
| 3,434,967 | 3/1964 | Oldenburg | 208/309 |
| 3,696,021 | 10/1972 | Cole et al. | 208/188 |
| 3,733,259 | 5/1973 | Wilson et al. | 208/309 |
| 3,779,895 | 12/1973 | Wilson et al. | 208/309 |
| 4,021,335 | 5/1977 | Beaton | 208/309 |
| 4,125,458 | 11/1978 | Bushnell et al. | 208/309 |

FOREIGN PATENT DOCUMENTS

| | | | |
|---|---|---|---|
| 1340022 | 12/1973 | United Kingdom | 208/309 |
| 1384290 | 2/1975 | United Kingdom | 208/309 |
| 2024849 | 1/1980 | United Kingdom | 208/309 |
| 0134088 | 3/1985 | United Kingdom | 208/309 |

*Primary Examiner*—Andrew H. Metz
*Assistant Examiner*—Helane Myers
*Attorney, Agent, or Firm*—Robert F. Delbridge; Arne I. Fors

[57] ABSTRACT

A process for the simultaneous de-emulsification and de-asphalting of heavy oil/water emulsions containing asphaltics enables de-asphalted oil, asphaltics and emulsion water to be separately recovered. A heavy oil/water emulsion is mixed with a solvent to cause the emulsion to be broken with consequent dissolution of oil by the solvent and coalescence of emulsion water and asphaltics as fast settling particles, the solvent comprising a light $C_4$ to $C_7$ paraffinic composition and the weight of solvent being from about 2 to about 5 times the weight of heavy oil. The water/asphaltic particles are separated from the bulk of the oil/solvent phase and are fed into a water bath to produce relatively large stable asphaltic agglomerates with exclusion of emulsion water. The asphaltic agglomerates are removed from the hot water bath, and de-asphalted oil is recovered from the oil/solvent phase. Heavy oil containing asphaltics can also be treated by the process, with the separated asphaltics agglomerating in the hot water bath.

10 Claims, 1 Drawing Figure

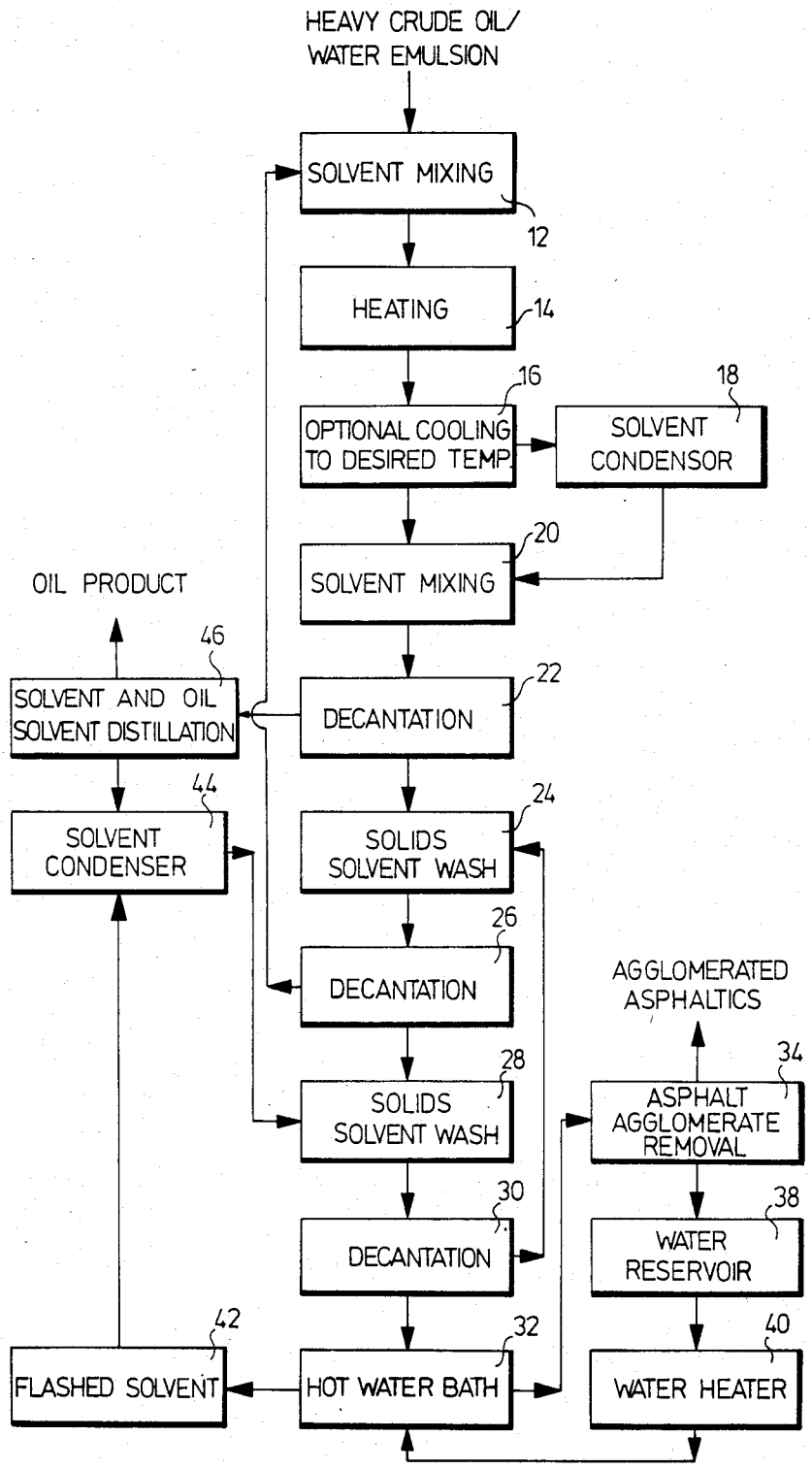
HEAVY CRUDE OIL/
WATER EMULSION
SOLVENT MIXING
12
HEATING
14
16
OPTIONAL COOLING
TO DESIRED TEMP.
18
SOLVENT
CONDENSOR
20
SOLVENT MIXING
OIL PRODUCT
46
SOLVENT AND OIL
SOLVENT DISTILLATION
22
DECANTATION
44
SOLVENT
CONDENSER
24
SOLIDS
SOLVENT WASH
26
DECANTATION
AGGLOMERATED
ASPHALTICS
28
SOLIDS
SOLVENT WASH
34
ASPHALT
AGGLOMERATE
REMOVAL
30
DECANTATION
38
WATER
RESERVOIR
42
FLASHED SOLVENT
32
HOT WATER BATH
40
WATER HEATER

DE-ASPHALTING HEAVY CRUDE OIL AND HEAVY CRUDE OIL/WATER EMULSIONS

This invention relates to de-asphalting heavy crude oil and heavy crude oil/water emulsions.

Most heavy crude oil production employs enhanced oil recovery techniques such as steam flood or fire flood. In such cases, the heavy oil is recovered as stable oil/water emulsions containing from about 10% to about 90% by weight of water. These emulsions are difficult and expensive to break. However, de-emulsification is a prerequisite to moving or treating the oil.

Common de-emulsification techniques include the use of de-emulsifying agents, heating, dehydration and solvent dilution. Solvents are chosen to dissolve the entire oil, lowering the viscosity to allow water movement.

It is known that asphalt containing oils or residiums can be de-asphalted using light hydrocarbon paraffinic solvents having compositions from $C_3$ to $C_{10}$. By this method the heavy oil is diluted with solvent in amounts ranging from 2 to 10 times the volume of heavy oil. Asphaltics are precipitated and removed by liquid/solids separation techniques. Prior art has established that pentane, or mixtures that are largely pentane, is the best de-asphalting solvent in terms of oil yield. Because pentane is normally a liquid at ambient temperatures and pressures, de-asphalting can be done in atmospheric or low pressure vessels using liquid/solids separation techniques. This is an advantage for field use where simplicity is most desirable.

Frequently however, the asphaltic precipitate obtained under such conditions is too fine to be easily recovered. Various techniques have been developed to enhance the separation of such precipitates. For example, it has been found that heating the solvent-oil mixture causes the asphaltic particles to coalesce. Stable agglomerates of about 15 micron size are formed which settle readily. Others propose the addition of fresh water (U.S. Pat. No. 4,021,335) to reduce solvent requirements, and some propose the creation of oil/water dispersions at high temperature (400° C. to 450° C.) which permits partial asphaltic removal without solvent (U.S. Pat. No. 3,779,895).

Unexpectedly, we have found that upon dissolving well head emulsions in 2 to 5 times by weight of pentane or mixtures of butane, pentane and hexane which are largely pentane, the solvent insoluble asphaltics coalesce around the dispersed water of emulsion. The appearance is that of water droplets stabilized by a sheath of asphaltics. The formation of these mixed particles is as rapid as the oil and solvent can be mixed. Removal of these mixed particles from the oil-solvent can be achieved by settling, centrifugation or cyclonning.

The recovery of both asphaltics and water is very high, resulting in a well de-asphalted oil. No deemulsifying agents are required and, because the mixed particles of water and asphaltics are relatively large, the separation is rapid and easy. In some cases, heating the oil-solvent mixture to temperatures between ambient and 110° C. results in beneficially larger particles. In any event, heating is carried out under sufficient presure to keep the solvent in liquid form. The liquid/solids separation can be carried out either at the required heating temperature or at lower temperature if it is useful or convenient to do so.

Usually, heating to 60° C. or less is sufficient. The larger particles are larger versions of the small ones, namely a sheath of fine asphaltic coalesced around water droplets. The association of water and asphaltics is further characterized by examining the recovered precipitate. Only traces of free water can be found. The asphaltics and water remain as a stable mixed phase. The stability of these coalesced water-asphaltic particles is not as great as the asphaltic-only particles created in the absence of emulsion water, but it is sufficient to permit efficient mechanical separation.

Upon separation and washing of the water-asphaltic precipitate, the mixture contains the fine asphaltics, water, oil free solvent, fine sand and clay. Conventional practice would heat the asphaltics and solvent to a temperature above the melting point of the asphaltics, then flash the mixture into a column for solvent recovery while the asphaltics would be recovered in molten form. Another method (U.S. Pat. No. 3,434,967) introduces the molten asphaltics to a hot water bath where the asphaltics are granulated and the solvent driven off. These approaches are undesirable in this case because of the amount of water associated with the asphaltics. Alternatively, the mixture might be filtered to recover both the solvent and the water. This approach is likewise not practicable. The coalesced asphaltic-water particles have a size of 30–50 microns, but the actual size of the discrete asphaltics is 5–10 microns. On a filter, the coalesced mixed particles breakdown and rapidly block the filter media.

To complete the process of our invention, which is designed to accept and remove water of emulsion, we have discovered how to separately recover water, asphaltics and solvent. The mixture of solvent, water, asphaltics, sand and clay is introduced to a hot water bath. The temperature of the bath is preferably maintained between the boiling temperature of the solvent and 100° C., or preferably between about 60° and about 95° C. Virtually instantaneously, the solvent is expelled, the emulsion water is absorbed into the water bath, and the asphaltics together with sand and clay are agglomerated into pea size particles. These agglomerates are easily skimmed from the bath and remain strong for easy handling and storage. Also, metal values may be preicipitated in the hot water bath and agglomerated with the asphaltics. The bath water remains clean of solids, and in most cases generates a net water effluent for possible re-use in the well injection system.

The quality of the emulsion water varies widely with respect to acidity, dissolved metals, salt content and organic content. Because the asphaltic agglomerates capture other solid particles as well, the bath can be beneficially used as partial water treatment. For example, partial neutralization and metal precipitation may be accomplished by lime addition. The precipitate so generated is encapsulated by the agglomerates so that separate precipitate removal is not required.

In some cases, the heavy oil emulsion water may contain certain soap-like surfactants which interfere with the formation of agglomerates. We have found that slight addition of acid or alkali overcomes that effect. The acid may be sulphuric acid, and the alkali may be lime.

Thus, our invention permits simultaneous deemulsifying, de-asphalting and de-salting with a degree of practicable simplicity suitable for field use. The invention is also useful with heavy oil which does not contain water, since asphaltics which agglomerate in the hot bath are produced.

BRIEF DESCRIPTION OF THE DRAWING

One embodiment of the invention will now be described, by way of example, with reference to the accompanying drawing which shows a diagrammatic flow sheet of a process for de-emulsifying and deasphalting a heavy crude oil/water emulsion.

Referring to the drawing, a heavy crude oil/water emulsion is fed to mixing step 12 where it is mixed with a hydrocarbon solvent such as pentane, hexane or petrolether (which is about 85% pentane) from a step which will be described later. In the mixing step 12, the emulsion may be pumped along a pipe with the solvent being injected into the pipe in such a manner as to effect adequate mixing.

If the mixture is not already at the desired temperature, the mixture passes to heating step 14 where external heat is applied under sufficient pressure to prevent boiling of the solvent, the normal boiling point of such solvent being about 38° C. In the heating step 14, the pipe carrying the mixture may be heated by external heat in any suitable manner, with the pressure in the pipe being as described above.

However, the emulsion treated in this process may already be at a suitable temperature because heavy crude oil is commonly recovered hot from a well. In this case, external heat may not be required, and in fact the emulsion may have to be allowed to cool so that excessively high temperatures and pressures are not generated.

During the heating step 14, the emulsion is broken and the colloidal asphaltics and water coalesce to form larger particles. The mixture is then cooled if desired by flashing off some of the solvent in cooling step 16 by releasing the pressure. The flashed solvent is condensed in condensing step 18 and recycled to mixing step 20 where it is mixed with cooled mixture from cooling step 16.

After mixing step 20, the mixture then proceeds to three stages of countercurrent washing and decantation steps 22, 24, 26, 28, 30. Fresh solvent is introduced to the final washing step 28, while the oil loaded solvent is removed from decantation step 22. The oil loaded solvent proceeds to distillation step 46 to produce the oil product, and the distilled solvent is condensed in condensing step 44, from which solvent is supplied to final washing step 28. Liquid from decantation step 26 is recycled to mixing step 12, and liquid from decantation step 30 is recycled to wash step 24.

From the final decantation step 30, the settled solids, water and entrained solvent are introduced to hot water bath 32. In this bath, typically 85°–95° C., the residual solvent is flashed off, the water from the emulsion is absorbed into the bath and the asphaltics agglomerate to pea size particles. These larger particles float and are skimmed from the water in step 34, and removed to storage. The water is recycled through reservoir 38 and heater 40 to the water bath 32. The flash solvent is recycled to solvent condenser 44.

Sand and/or clay in the heavy oil is agglomerated in the hot water bath 32 with the asphaltics. This may cause the agglomerates to sink in the bath, in which case they can be removed from the bottom of the bath.

Tests in accordance with the prior art and the present invention will now be described.

EXAMPLE 1 (PRIOR ART)

Heavy crude oil/water emulsion recovered by fire flood from a well in the Lloydminster area of the Province of Alberta, Canada, contained roughly 68% water. A first test using ambient temperature petrolether deasphalting was carried out on a 200 g sample, in accordance with the prior art, and a precipitate was obtained. However, even after long standing, the precipitate did not settle appreciably. Using filtration, which was very slow, the test was completed. The washed filter cake weighed 155 g while the oil recovered weighed 51 g. The filter cake held all the water of emulsion as well as some petrolether, but no water was seen. On drying, the filter cake weighed 17.5 g.

EXAMPLE 2 (INVENTION)

A test using a process of the invention was then carried out on a further sample. The mixture of crude oil/water emulsion and solvent was first heated to 60° C., then cooled to ambient temperature. Within 2 minutes, the precipitate settled to a volume of 200 cc from an initial volume of 1300 cc and within 5 minutes the supernatant was clear. The supernatant was easily decanted from the settled solids, and two stages of washing followed in similar fashion. Solids from the third decanting was then dumped into a hot water bath of known volume. Pea size granuled of asphaltics removed from the bath weighed 56 g wet, and 18 g dry, while the bath water volume increased by 100 cc. The weight of oil recovered after distillation was 50 g.

EXAMPLE 3 (PRIOR ART)

A sample of heavy oil from Peru weighed 213 g and contained 30% by weight water. The sample was deasphalted with 5 times by weight of petrolether at room temperature. No settling was observed but the deasphalting was labouriously completed by filtration. The percent asphaltics recovered was 23% by weight which agreed with the supplied analyses. The asphaltics contained all of the water, although none was visibly free in the precipitate.

EXAMPLE 4 (INVENTION)

The above experiment was repeated with preheating to 78° C. Roughly half of the asphaltics settled rapidly and contained all of the water although again, none was visibly free.

EXAMPLE 5 (INVENTION)

The experiment was repeated again at 110° C. This time the entire 22% asphaltics settled rapidly and again contained all of the water in a completely mixed phase.

EXAMPLE 6 (INVENTION)

A sample of heavy oil from Buffalo Creek, Alberta, contained 30% water. The sample was deasphalted with 5 times petrolether by weight at 60° C. and the asphaltics introduced to the hot water bath. Agglomeration was not particularly satisfactory because the bath became frothy due to natural surfactants introduced with the asphaltics. The fine asphaltic agglomerates were found to contain 65% water.

EXAMPLE 7 (INVENTION)

This experiment was repeated after adding a small amount of acid ($H_2SO_4$) to the bath. This time frothing was eliminated, the agglomerates were more compact and contained only 38% water.

EXAMPLE 8 (INVENTION)

A sample of Athabasca bitumen was 40% bitumen and 60% fine sand and clay. This sample was de-asphalted with 5 times petrolether at room temperature. The settled precipitate together with sand and clay was introduced to the hot water bath. The agglomerates of asphaltics contained all of the sand and clay leaving the bath water clean of solids. In this case, the large quantity of sand caused the asphaltic agglomerates to sink rather than float. They were removed by decanting the water rather than skimming off the top surface.

Other examples and embodiments of the invention will be readily apparent to a person skilled in the art, the scope of the invention being defined in the appended claims.

What we claim as new and desire to protect by Letters patent of the United States is:

1. A process for the simultaneous de-emulsification and de-asphalting of heavy oil/water well head emulsions containing asphaltics which enables de-asphalted oil, asphaltics and emulsion water to be separately recovered, said process comprising:

mixing a heavy oil/water well head emulsion with a solvent to cause the emulsion to be broken with consequent dissolution of oil by the solvent and coalescence of emulsion water and asphaltics as fast settling particles, said solvent comprising a light $C_4$ to $C_7$ paraffinic composition and the weight of solvent being from about 2 to about 5 times the weight of heavy oil, said fast settling particles each comprising a water droplet stabilized by a sheath of asphaltics, separating the water/asphaltic particles from the bulk of the oil/solvent phase, feeding the separated water/asphaltic particles and residual solvent into a hot water bath to produce relatively large stable asphaltic agglomerates with exclusion of emulsion water and with said residual solvent being flashed off, recovering the flashed off solvent, removing the asphaltic agglomerates from the hot water bath, and recovering de-asphalted oil from the oil/solvent phase.

2. A process according to claim 1 wherein the heavy water/oil emulsion and solvent mixture is at an elevated temperature less than about 110° C. while maintaining the solvent in liquid form to cause the emulsion to be broken with consequent dissolution of heavy oil by the solvent and coalescence of emulsion water and asphaltics as fast settling particles.

3. A process according to claim 1 wherein the separated water/asphaltic particles are washed with fresh solvent to remove residual oil before feeding into the hot water bath.

4. A process according to claim 1 wherein the solvent is selected from the group consisting of butane, pentane, petrolether, hexane and mixtures thereof.

5. A process according to claim 1 wherein the temperature of the hot water bath is between the boiling temperature of the solvent and 100° C.

6. A process according to claim 1 wherein sand and/or clay is associated with the heavy oil and is agglomerated in the hot water bath with the asphaltics.

7. A process according to claim 6 wherein sand and/or clay cause the agglomerates to sink in the bath.

8. A process according to claim 1 wherein the agglomerates float in the bath.

9. A process according to claim 1 wherein acid or alkali is added to the hot water bath to facilitate production of the asphaltic agglomerates.

10. A process according to claim 1 wherein metal values in the emulsion water are precipitated in the hot water bath and agglomerated with the asphaltics.

* * * * *